United States Patent [19]

Gillbrand et al.

[11] Patent Number: 4,903,676

[45] Date of Patent: Feb. 27, 1990

[54] METHOD AND ARRANGEMENT FOR IMPROVING THE STARTING ABILITY OF AN INTERNAL COMBUSTION ENGINE DURING AN ENGINE START

[75] Inventors: Per Gillbrand, Mariefred; Hans Johansson; Jan Nytomt, both of Åmål, all of Sweden

[73] Assignee: Saab-Scania Aktiebolag, Sweden

[21] Appl. No.: 236,665

[22] Filed: Aug. 25, 1988

[30] Foreign Application Priority Data

Aug. 28, 1987 [SE] Sweden ..... 8703330

[51] Int. Cl.[4] ..... F02P 15/08

[52] U.S. Cl. ..... 123/639; 123/637

[58] Field of Search ..... 123/636, 639, 620, 637, 123/598, 606

[56] References Cited

U.S. PATENT DOCUMENTS

| | | | |
|---|---|---|---|
| 3,170,451 | 2/1965 | Fortier et al. | 123/637 |
| 3,589,348 | 6/1971 | Reishhelm | 123/639 |
| 3,620,201 | 11/1971 | Warren et al. | 123/639 |
| 3,636,936 | 1/1972 | Schuette et al. | 123/637 |
| 4,024,469 | 5/1977 | Bobulski | 324/16 R |
| 4,133,329 | 1/1979 | Caron | 315/209 CD |
| 4,341,195 | 7/1982 | Nishio et al. | 123/598 |
| 4,369,756 | 1/1983 | Ezoe | 123/620 |
| 4,442,821 | 4/1984 | Hamai et al. | 123/639 |
| 4,479,467 | 10/1984 | Burrows et al. | 123/606 |
| 4,637,368 | 1/1987 | Gillbrand et al. | 123/647 |
| 4,653,459 | 3/1987 | Herden | 123/637 |

FOREIGN PATENT DOCUMENTS

| | | | |
|---|---|---|---|
| 963525 | 2/1975 | Canada | 123/639 |
| 0142478 | 5/1985 | European Pat. Off. | 123/639 |
| 2645226 | 4/1978 | Fed. Rep. of Germany | 123/639 |
| 55-112870 | 2/1979 | Japan | 123/637 |

*Primary Examiner*—Raymond A. Nelli

*Attorney, Agent, or Firm*—Ostrolenk, Faber, Gerb & Soffen

[57] ABSTRACT

The invention relates to a method and an arrangement for improving the starting ability of an internal combustion engine during difficult engine starting conditions that result from cold weather or other external circumstances. Lower than normal engine starting speeds can occur during cold weather, for example. So as not to hinder an engine start, it is essential that the spark plugs be free from deposits and in their best condition. This is achieved by burning off any deposits present on spark plugs during an engine start attempt, when difficult engine starting conditions are detected. During an engine start attempt a comparison circuit ascertains whether or not one or more detected engine parameters have a lower value than in normal engine starting conditions. The comparison circuit sends a signal to the control unit controlling the ignition system, so that the control unit will initiate the generation of a plurality of sparks, instead of a single spark, at ignition time points. The resultant spark shower then burns off any deposits that are present.

24 Claims, 3 Drawing Sheets

METHOD AND ARRANGEMENT FOR IMPROVING THE STARTING ABILITY OF AN INTERNAL COMBUSTION ENGINE DURING AN ENGINE START

FIELD OF THE INVENTION

The invention relates to a method and arrangement for improving the starting ability of an internal combustion engine during difficult engine starting conditions.

BACKGROUND OF THE INVENTION

One earlier known method for maintaining the spark plugs of an internal combustion engine free from deposits involves the repeated generation of sparks between the spark plug electrodes.

The U.S. Pat. No. 4,341,195 teaches an ignition system in which, under certain engine conditions and when running of the engine has become established, a spark discharge is generated continuously across the plug with the aid of a specific ignition circuit. The number of discharges generated is inversely proportional to the speed of the engine and proportional to the engine load.

The U.S. Pat. No. 4,024,469 teaches an arrangement in which the plug gap is measured by means of a measuring system which is connected to an ignition system and which applies a high alternating voltage across the plug, so as to burn-off deposits present thereon.

The German Patent Specification No. 26 45 226 describes an ignition system with which a thin-walled precombustion chamber is heated, by repeatedly effecting an electrical discharge across the spark plugs. For the purpose of facilitating an engine start in cold and moist conditions, arrangements have also been proposed for heating the actual spark plugs with the aid of a direct current; cf. for instance U.S. Pat. No. 3,589,348.

This prior art has presented complicated solutions which require the provision of numerable ancillary devices and components additional to the conventional ignition system. In some cases the ignition system has been incapable of burning-off carbon deposits effectively, particularly in difficult engine start conditions.

OBJECTS AND SUMMARY OF THE INVENTION

The object of the invention is to control selectively the ignition system of an internal combustion engine, preferably a multi-cylinder Otto engine, during the course of an engine start, so that a multiple of sparks are generated for effectively burning-off any deposits present in the spark-plug gap.

The foregoing object is achieved in a method for improving the starting ability of a four-stroke internal combustion engine of the type including an ignition system having a charging circuit for storing charge; a coil for receiving discharges from the charging circuit; and a spark plug having a pair of electrodes spaced by a gap, energized by the coil, and associated with a cylinder containing a piston. The method comprises the step of determining when a difficult engine starting condition exists; and when such condition is detected, comprises the further step of causing the charging circuit to discharge repeatedly across the spark plug gap when the piston occupies or is adjacent a top-dead-center-position, irrespective of whether the piston is in its compression or exhaust stroke. The method thereby produces a spark shower across the plug gap at each exhaust stroke, so as to burn off any deposits on the spark plug electrodes.

The inventive method enables the control unit of the ignition system to operate in two functional positions. In one of these positions, or states, the control unit sends single control pulses to the charging and discharging circuits, so that in the case of a normal engine start a single spark is obtained at respective ignition times. When the control unit is in its second position, or state, the control unit sends a plurality of control signals to the charging and discharging circuits, so as to produce a plurality of sparks in close succession at respective ignition times when difficult engine start conditions prevail.

When starting, for instance, the engine of an automotive vehicle, the method enables the spark plugs to be brought to their best condition, and ensures that ignition is obtained in all cylinders. In the case of a normal engine start at an engine temperature of at least +15° C., the starting motor will turn the engine at a speed of about 400 rpm. Normally no starting problems occur in the case of such engine starts. When an attempt is made to start an engine at temperatures around −30° C., however, this engine speed is as low as 60–80 rpm. At engine starting speeds as low as this, it is essential that the spark-plug gap is in its best condition, since deposits or coatings on one or more spark plugs may render it impossible to start the engine.

During the actual engine starting process itself a coating of moisture is liable to be precipitated onto respective spark plugs. This moisture coating may result, for instance, from an excessively rich fuel-air mixture or because ignition has failed to take place in the cylinder. In the case of conventional spark plugs, the isolators will then become coated with moisture, rendering the isolators electrically conductive. This prevents normal sparking between the spark plug electrodes, since the current creeps from the central electrode across the isolator to the earthed part of the spark plug.

The inventive generation of repeated control signals from the conventional ignition system results in the production of a shower of sparks at the regular ignition time of respective cylinders, each spark having the same energy content as a normal or ordinary ignition spark. In the case of a capacitive ignition system having an ignition voltage of up to 40,000 volts, the power development afforded by the spark shower is of such long duration that any deposits present on or adjacent to the spark plug electrodes are effectively burned away. Preferably, at least 5-6 sparks are generated on each spark plug at each moment of ignition in the cylinder concerned.

The present invention also relates to an arrangement for carrying out the inventive method. The arrangement is based on an ignition system of the kind previously described, for instance, in the Swedish Patent Specification No. 437 286, corresponding to U.S. Pat. No. 4,637,368, and also of the kind having a charging circuit for storing charge; a coil for receiving discharges from the charging circuit; and a spark plug having a pair of electrodes spaced by a gap, energized by the coil, and associated with a cylinder containing a piston.

The apparatus of the invention includes control means for determining when a difficult starting condition exists and, when such condition is detected, for causing the charging circuit to discharge repeatedly across the spark plug gap when the piston occupies or is adjacent a top-dead-center position, irrespective of whether the piston is in its compression or exhaust stroke. The apparatus of the invention thus produces a spark shower across the plug gap at each exhaust stroke, so as to burn off any deposits on the spark plug electrodes. A logic comparator, which is necessary to the invention and which detects difficult engine-start conditions during an engine start and which controls the function of the control unit, may have the form of a separate logic circuit. In the case of ignition systems of the kind disclosed in SE No. 437 286, however, the comparator instead advantageously comprises a comparison module which is programmed into a microcomputer-based control unit. Such programming obviates the need to provide additional components, since one of the engine parameters sensed or detected by the control unit forms the basis of the comparison.

Other characteristic features of the invention are disclosed in the following claims and are also made apparent in the following description of an exemplifying embodiment of the invention.

BRIEF DESCRIPTION OF THE DRAWINGS

The description is made with reference to the accompanying drawings, in which:

FIG. 1 illustrates schematically a four-cylinder Otto-engine 1 and a crankshaft sensor or transducer 7 fitted thereto, said sensor being connected to a microcomputer-controlled ignition system 2 by means of a line 8. The system includes a control unit 3 in which a microcomputer or microprocessor calculates the ignition timing for respective engine cylinders on the basis of input signals from the crankshaft sensor 7, an inlet pressure sensor 7″, an engine temperature sensor 7′ and optionally other sensors or transducers. The ignition system 2 further includes a comparison circuit 5 which is connected to data lines 8,8′,8″. The comparison circuit 5 detects the values in question from the sensors 7-7″ and sends a signal on a line 6 to the control unit 3 when the value or values are beneath a predetermined value. The ignition system 2 is, advantageously, a capacitive system and also includes a charging circuit 4. In addition hereto, the ignition system 2 incorporates discharging circuits 9 and ignition circuits 10 connected with the spark plugs 11–14 of respective cylinders C1, C2, C3, C4.

The cylinders are divided into pairs C1, C3; C2, C4, in which pistons run parallel with one another in a known manner but at a phase difference of 360 crankshaft-angle degrees (hereinafter referred to solely as degrees). When the piston in one cylinder C1 of the cylinder pair C1, C3 carries out its compression stroke, the piston of the other cylinder C3 performs an exhaust stroke. The pistons of the one cylinder pair C1, C3, on the other hand, run with a 180-degrees difference in relation to the pistons of the other cylinder pair C2, C4, whereby when the pistons of one cylinder pair C1, C3 occupy their upper top dead-centre position the pistons of the other cylinder pair C2, C4 occupy their bottom-dead-centre positions.

Figure 1:
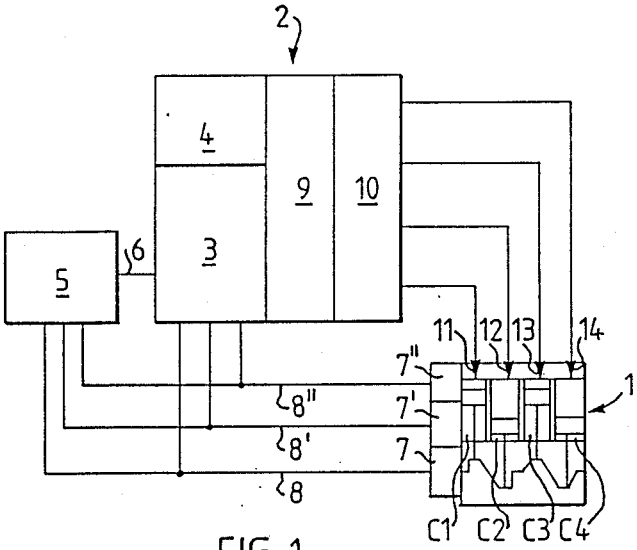
FIG. 1 is a block schematic illustrating an inventive arrangement used in conjunction with an internal combustion engine.
Figure 2:
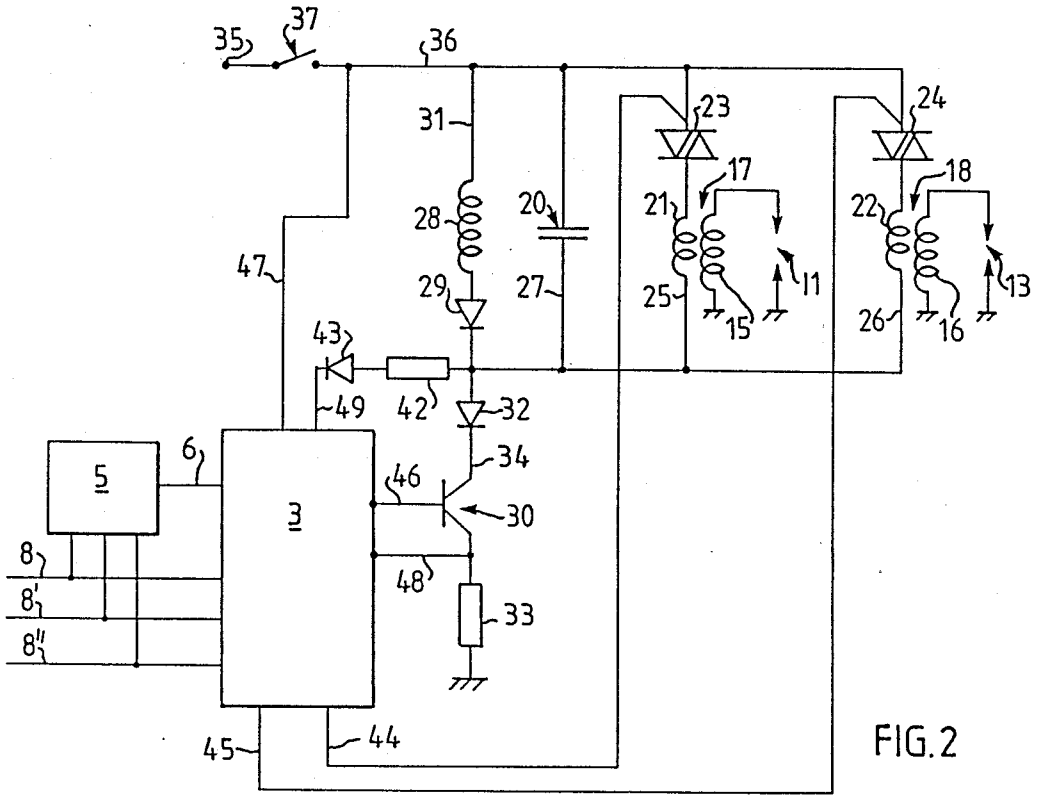
FIG. 2 is a circuit diagram of the engine ignition system.

FIG. 2 illustrates a circuit diagram for an exemplifying embodiment of the ignition system 2 shown in FIG. 1. Of the spark plugs 11–14 shown in FIG. 1, only the plugs 11 and 13 are shown in FIG. 2, and then only schematically, each of said plugs being connected to a respective secondary winding 15, 16 of a corresponding number of ignition coils 17, 18. Each of the primary windings 21, 22 of the ignition coils 17, 18 is connected in series with a respective switching device 23, 24, in this case in the form of triacs. Each primary winding 21, 22 and triac 23, 24 forms a discharging circuit 25, 26 which is connected in parallel with an ignition capacitor 20 incorporated in a line 27.

The discharging circuit 4 used for the ignition capacitor 20 has the form of a choke 28 connected in series with a diode 29 in a line 31, which is connected in parallel with the ignition capacitor 20. The line 27 with the ignition capacitor 20 and all lines 25, 26, 31 connected in parallel therewith are connected at their respective ends to a second switching device 30, e.g. a transistor incorporated in an earthing line 34. The transistor is connected in series with a second diode 32 and a resistor 33. The other ends of respective lines 25, 26, 27, 31 are connected to a direct current source 35, preferably a 12 V battery, via a line 36 which incorporates a switch 37 included in an ignition lock. The diodes 29, 32 are turned so that when the transistor 30 is open for the passage of current, current can be supplied from the battery 35 through the lines 31, 34 to earth.

The triacs 23, 24 in the discharge circuits 9 and the transistor 30 in the charging circuit 4 are controlled by signals arriving on lines 44, 45 and 46 respectively from the control unit 3. In addition to the input signals on the lines 8, 8′, 8″, shown in FIG. 1, the control unit 3 is also supplied on a line 47 with an input signal relating to the voltage level of the battery 35. A line 48 connects the control unit 3 with the line 34 between the transistor 30 and the resistor 33, and transfers to the control unit 3 a potential which corresponds to the charging current of the ignition capacitor 20. The control unit 3 is also supplied with data relating to the potential of the ignition capacitor 20, via a line 49 incorporating a resistor 42 and a diode 43.

In the case of the inventive arrangement illustrated in FIG. 2, the control unit 3 obtains on the line 6 a signal from the comparison circuit 5 in those instances when the comparison circuit 5 has detected a difficult engine-start condition. The comparison circuit 5 senses the engine parameters concerned from the sensors 7, 7′, 7″ on the lines 8, 8′, 8″ and compares the prevailing values with pre-determined values which represent the engine parameter values relevant for conditions under which the engine will readily start.

When the engine starting speed constitutes the basis upon which difficult engine-start conditions are indicated, detection is commenced immediately after activation of the starting motor. Only two speed pulses from the crankshaft sensor 7 are required to enable the comparison circuit 5 to be able to detect a difficult engine start, and in such cases to send a signal on the line 6 to the control unit 3. When the engine temperature and battery voltage are used as a basis for indicating difficult engine-start conditions, the comparison circuit 5 may be constructed so as to send a signal on the line 6 to the control unit 3 before the starting motor is activated.

In principle, the arrangement illustrated in FIGS. 1 and 2 operates in the following manner.

When starting the engine 1 under both difficult and not-difficult engine start conditions, the switch 37 closes the line 36 and the battery 35 is connected to earth, via the lines 31, 34 with the choke 28, the diodes 29, 32, the transistor 30 and the resistor 33. The control unit 3 therewith holds the triacs 23, 24 closed, whereas the transistor 30 is held open for the passage of current therethrough. When the charging current and a corresponding potential on the line 48 have reached a predetermined value, the control unit 3 interrupts the current through the transistor 30. Energy stored in the choke 28 is therewith transferred to the capacitor 20, which is thereby charged. When the control unit 3 sends an output signal, e.g. to the triac 23 in response to the input signals on the lines 8, 8', 8'' at the ignition time point determined in the control unit 3 on the basis of the input signals, the triac 23 is opened and the ignition capacitor 20 is discharged through the primary winding 21. In this way there is generated in the secondary coil 15 an ignition voltage which produces an ignition spark on the spark plug 11 at the determined ignition time. The potential of the ignition capacitor 20 is detected by the control unit 3 via the line 49, and when the detected value lies beneath a predetermined value, the control unit 3 will initiate a new charging circle, by sending an output signal on the line 46 to the transistor 30, causing the transistor to open. The triac 23 has, at the same time, reclosed the line 25, preventing current from flowing therethrough. Consequently, recharging of the ignition capacitor 20 will commence immediately upon termination of the discharge, so as to recharge the capacitor 20 quickly for the next ignition process. In the case of an 11 V battery voltage, this charging period is up to 6 ms, whereas in the case of a 5 V voltage charging of the capacitor will take up to 12 ms, or at least less than 15 ms. At occurring starting speeds, these times correspond to between about 2 and 10 degrees of crankshaft rotation.

Should the control unit 3 receive a signal on the line 6 from the comparison circuit 5 indicating that a difficult engine start condition prevails, the control unit 3 will send a plurality of output signals on the line 44 to the triac 23 so that the regular ignition spark generated across the spark plug 11 at said given ignition time is followed by a multiple of sparks in closed succession.

If the ignition sequence is not determined, the control unit 3 begins to send control signals to both triacs 23, 24, whereby sparks are applied across both spark plugs 11, 13 in both cylinders C1, C3 when the pistons are located at a distance of 8°–12°, preferably 10°, from the top dead centre position, which corresponds to a normal ignition setting in the compression stroke. In this way, the compression stroke is not counteracted by the application of the sparks. The control unit 3 is then able to apply the sparks to the pistons until said pistons are located up to about 60° after the top dead centre position. This obviates the risk of igniting the fuel-air mixture drawn into the cylinder upon commencement of the suction stroke.

By controlling the transmission of control signals from the control unit to the triacs 23, 24 in accordance with a time sequence in which the control unit waits 12–15 ms after sending the first control signal, the ignition capacitor 20 will be charged to a maximum down to 5 V battery voltage. This time control will enable a spark shower containing at least 5–6 sparks to be applied with maximum energy within said crankshaft angle range down to 5 volts battery voltage and at typical engine starting speeds.

The control unit 3 may also detect the potential of the ignition capacitor 20 via the line 49, and when the potential detected is sufficient the next control signal to the triacs 23, 24 can be delivered immediately. This enables a spark shower containing more than 5–6 sparks to be applied within said crankshaft angle range.

Due to the rapid build-up of an electric charge in the ignition capacitor 20 of the ignition system 2, and to the rapid discharge process and also to the ability of the capacitive ignition system to produce ignition voltages of up to 40,000 volts, any deposits on the spark plug electrodes will be effectively burned-off by said spark shower during the engine start.

In this regard, those deposits which are often found in the vicinity of the electrodes, and particularly the deposits formed on the isolator of the centre electrode, are also effectively burned away, in addition to deposits present on the spark plug electrodes themselves.

Figure 3:
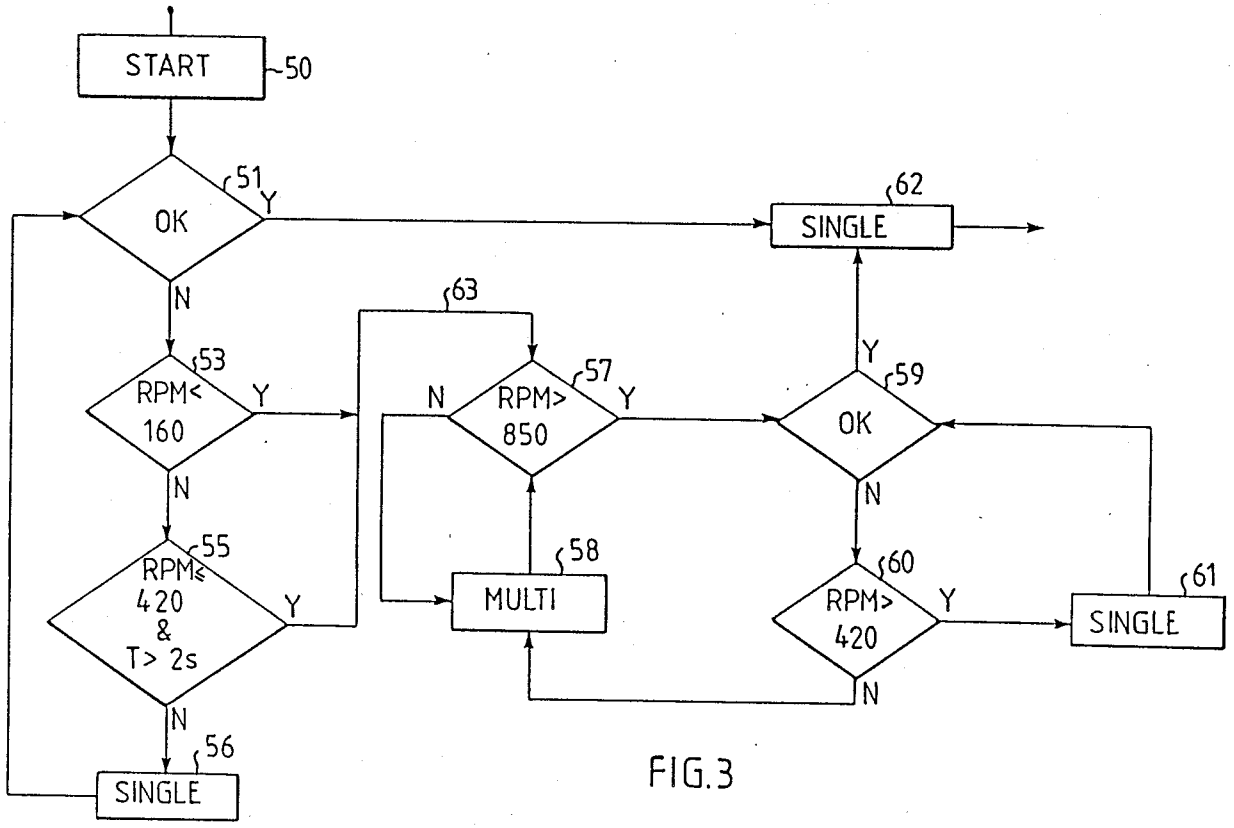
FIG. 3 is a flow sheet which illustrates an inventive method for controlling the ignition system.

In accordance with a preferred embodiment of the inventive method, when starting an engine the control unit 3 is controlled in accordance with a start program stored in the microcomputer of the control unit, in response to the detected engine speed, as illustrated in the flow sheet shown in FIG. 3.

The program begins when the ignition system is activated as a result of the application of a voltage via a conventional ignition lock, having an operation stage 50 in which pulses in the crankshaft sensor 7 output signal are applied to the cylinder pairs C1, C3 and C2, C4 respectively in a known manner. The pulses belonging to respective cylinder pairs are produced with a spacing of 180 degrees.

A check is made in a following operation stage 51 to establish whether or not running of the engine is established, i.e. that the engine start sequence has been terminated.

When the exemplified ignition system 2 does not incorporate a cam shaft sensor, the ignition sequence will not be given directly by the signals from the crankshaft sensor 7, these signals solely indicating those pistons of the cylinder pairs C1, C3 and C2, C4 which occupy their top dead-centre position. Detection of which cylinder is in its compression stroke can be effected by sensing the ionizing current across the spark plugs and determining the ignition sequence therefrom. This can be carried out with an ionizing current measuring arrangement of the kind described in detail in our Swedish Patent Specification No. 442 345. Thus, a check is carried out in the operation stage 51 to ascertain whether the ignition sequence is a determined sequence, so as to indicate whether the engine start sequence has been completed or not. If the ignition sequence is determined in the operation stage 51, the program will step forward to the operation stage 62, which results in the generation of a single spark on the cylinder concerned, whereafter the start program is left or abandoned. When the check carried out in the operation stage 51 shows that the ignition sequence is not a determined sequence it is assumed that the engine start sequence still prevails and the start program then steps to the operation stage 53.

Operation stage 53 is effective in determining whether or not a difficult engine start condition prevails. If the engine speed lies beneath 160 rpm, i.e. about 40% of a normal engine start speed, this indicates that a difficult engine start condition exists. The program then steps immediately, via the flow line 63, to those operation stages described hereinafter. If, however, the speed is above 160 rpm, the program steps to operation stage 55.

The operation stage 55 is effective in making a further check to ascertain whether a difficult engine start condition exists. If the engine has continued to run beneath a normal starting speed of about 420 rpm for more than 2 (two) seconds, this indicates that a difficult engine start condition prevails. The program then steps forward, via the flow line 63. If the engine speed lies above 420 rpm and the attempt to start the engine has not been longer than 2 (two) seconds, the program steps to the operation stage 56.

The operation stage 56 is effective in controlling the control unit 3 in a manner such as to generate a single spark immediately when the piston of respective cylinders is located in its top dead-centre position. The program then returns to program stage 51.

The flow line 63 extending from operation stages 53 and 55 also extends to a program stage 57 which introduces a sequence of measures when a difficult engine start condition is indicated. The operation stage 57 detects, or establishes, whether the engine speed is above 850 rpm. If the engine speed is beneath 850 rpm, the program is stepped to operation stage 58, which means that a plurality of sparks will be initiated with starts from said ignition position, whereafter the program returns to the operation stage 57. Consequently, under difficult engine start conditions, a plurality of sparks are delivered to each cylinder immediately when the piston in question occupies its top dead-centre position, until the engine speed is, preferably, twice the starting speed, corresponding to a normal engine starting speed. In the case of the illustrated embodiment, this value of twice the normal starting speed is about 850 rpm. When the operation stage 57 establishes that the engine speed exceeds 850 rpm, the program moves to a safety sequence which ascertains whether or not the engine is running smoothly.

The safety sequence begins with the operation stage 59, which determines whether or not it has been possible to determine the ignition sequence. If the ignition sequence is not determined, which means that an engine start sequence still prevails, the program moves to the operation stage 60, in which it is ascertained whether the engine speed is greater than 420 rpm or not. If the engine speed is above 420 rpm, the program moves to the operation stage 61, so as to generate a single spark adjacent each top dead-centre position and subsequently returns to the operation stage 59. If it is established in the operation stage 60 that the engine speed is below 420 rpm, the program returns to the operation stage 58, so as to generate a plurality of sparks. The engine start program is therefore not left until the engine ignition sequence is determined and the engine runs smoothly. The start sequence is not considered to be terminated until the operation stage 59 establishes that the ignition sequence is determined, and the program steps to the operation stage 62. In this case, a single spark is generated on respective cylinders in their ignition positions, whereafter the engine start program is left.

The aforedescribed inventive embodiment does not limit the scope of the invention, since several modifications can be made and other embodiments are possible within the scope of the following claims. FOr example, the reference to an ignition capacitor and the like is intended to cover solutions which use several parallel-connected ignition capacitors which operate functionally as a single capacitance.

It will be also understood that engine parameters other then engine speeds can be used, either directly or indirectly, for establishing the presence of difficult engine starting conditions. The operation stage 53 can be constructed to compare both the engine temperature and the battery voltage with predetermined values for normal engine starts, in order to indicate that a difficult engine start condition exists. Alternatively, the operation stage 55 can be constructed to ascertain that the ignition sequence has not been established within a given length of time.

In ignition systems with a determined ignition sequence, it is possible to ascertain in the operation stages 51 or 59 whether or not the ignition system has operated actively over a given minimum time period. By means of this time check it is possible to establish whether the engine is running smoothly and subsequently that the engine start sequence has been terminated.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A method for improving the starting ability of a four-stroke internal combustion engine of the type including an ignition system having a charging circuit for storing charge; a coil for receiving discharges from the charging circuit; and a spark plug having a pair of electrodes spaced by a gap, energized by the coil, and associated with a cylinder containing a piston; the method comprising the steps of:

determining when a difficult engine starting condition exists;

when such difficult engine starting condition is detected, causing the charging circuit to discharge repeatedly across the spark plug gap when a crankshaft of the engine is positioned in a range between a position about 10° before a top-dead center position and about 60° after the top-dead-center position, irrespective of whether the piston is in its compression or exhaust stroke, thereby to produce a spark shower across the plug gap at each exhaust stroke, so as to burn off any deposits on the spark plug electrodes; and terminating the shower of sparks upon determining that a difficult engine starting condition has ceased.

2. The method according to claim 1, wherein the determining step includes comparing an engine parameter with a reference value in determining whether a difficult engine starting condition exists.

3. The method according to claim 2, wherein the engine parameter is engine speed and the existence of a difficult engine starting condition is determined when the engine speed is below the reference value.

4. The method according to claim 1, wherein the determining step includes comparing an engine temperature and a battery voltage with respective reference values, and determining that a difficult engine start condition exists when either or both the temperature and voltage are below their respective reference values.

5. The method according to claim 1, wherein the four-stroke engine is a multi-cylinder engine with a respective spark plug like the first-mentioned spark plug in each cylinder; the method further comprising the step of causing the charging circuit to discharge repeatedly across each spark plug.

6. The method according to claim 1, wherein the ignition system comprises a capacitive ignition system.

7. The method according to claim 6, wherein the spark shower constitutes a series of sparks generated at a frequency in the order of 200 Hz.

8. The method according to claim 1, wherein the spark shower constitutes a series of sparks generated at a frequency in the order of 200 Hz.

9. The method according to claim 1, wherein the step of terminating the shower of sparks occurs when the engine speed is twice the engine speed corresponding to a normal engine starting speed.

10. The method according to claim 1, wherein the step of terminating the shower of sparks occurs when either or both the engine temperature and a battery voltage exceed respective reference values.

11. The method according to claim 2, wherein the reference value is 40% of a normal starting speed for a non-difficult engine start condition.

12. The method according to claim 1, wherein the determining step includes comparing engine speed with a reference speed and determining that a difficult engine start condition exists when the engine speed is lower that the reference speed throughout a predetermined interval.

13. Arrangement for improving the starting ability of a four-stroke internal combustion engine, comprising:

an ignition system included in the engine and having a charging circuit for storing charge; a coil for receiving discharges from the charging circuit; and a spark plug having a pair of electrodes spaced by a gap, energized by the coil, and associated with a cylinder containing a piston;

control means for determining when a difficult engine starting condition exists and, when such condition is detected, for causing the charging circuit to discharge repeatedly across the spark plug gap when a crankshaft of the engine is positioned in a range between a position about 10° before a top-dead-center position and about 60° after the top-dead-center position, irrespective of whether the piston is in its compression or exhaust stroke; thereby to produce a spark shower across the plug gap at each exhaust stroke, so as to burn off any deposits on the spark plug electrodes; and the control means further including means to terminate the shower of sparks upon determining that a difficult engine starting condition has ceased.

14. The arrangement according to claim 13, wherein the control means includes means to compare an engine parameter with a reference value in determining whether a difficult engine starting condition exists.

15. The arrangement according to claim 14, wherein the engine parameter is engine speed and the control means determines that a difficult engine starting condition exists when the engine speed is below the reference value.

16. The arrangement according to claim 13, wherein the control means includes to compare an engine temperature and a battery voltage with respective reference values, and for determining that a difficult engine start condition exists when either or both the temperature and voltage are below their respective reference values.

17. The arrangement according to claim 13, wherein:

the four-stroke engine is a multi-cylinder engine with a respective spark plug like the first-mentioned spark plug in each cylinder; and the control means includes means to cause the charging circuit to discharge repeatedly across each spark plug.

18. The arrangement according to claim 13, wherein the spark shower constitutes a series of sparks generated at a frequency in the order of 200 Hz.

19. The arrangement according to claim 13, wherein the ignition system comprises a capacitive ignition system.

20. The arrangement according to claim 19, wherein the spark shower constitutes a series of sparks generated at a frequency in the order of 200 Hz.

21. The arrangement according to claim 12, wherein the means to terminate the shower of sparks becomes operative when either or both the engine temperature and a battery voltage exceed respective reference values.

22. The arrangement according to claim 14, wherein the reference value is 40% of a normal starting speed for a non-difficult engine start condition.

23. The arrangement according to claim 13, wherein the control means includes means to compare engine speed to a reference speed and for determining that a difficult engine start condition exists when the engine speed is lower than the reference speed throughout a predetermined interval.

24. The arrangement according to claim 13, wherein the means to terminate the shower of sparks becomes operative when the engine speed is twice the engine speed corresponding to a normal engine starting speed.

* * * * *